US008162281B2

(12) United States Patent
Logue

(10) Patent No.: US 8,162,281 B2
(45) Date of Patent: Apr. 24, 2012

(54) PRESENTATION PAD EASEL

(76) Inventor: C. Robert Logue, Chicago, IL (US)

( * ) Notice: Subject to any disclaimer, the term of this patent is extended or adjusted under 35 U.S.C. 154(b) by 170 days.

(21) Appl. No.: 12/383,474

(22) Filed: Mar. 24, 2009

(65) Prior Publication Data

US 2010/0243854 A1 Sep. 30, 2010

(51) Int. Cl.
*A47B 97/04* (2006.01)

(52) U.S. Cl. ..... 248/447; 248/451; 248/462

(58) Field of Classification Search ..... 248/447, 248/448, 451, 458, 460, 462, 463, 464, 465; 281/29, 15.1, 33
See application file for complete search history.

(56) References Cited

U.S. PATENT DOCUMENTS 3,942,869 A * 3/1976 Portner et al. ..... 359/443
4,017,152 A * 4/1977 Allen ..... 359/443
4,300,300 A * 11/1981 Neuland et al. ..... 40/610
4,355,779 A * 10/1982 Heled ..... 248/460
5,010,671 A 4/1991 Stonehouse
5,697,595 A 12/1997 Sperger
6,647,652 B1 11/2003 Seiber et al.
6,889,952 B2 5/2005 Cook et al.
7,178,778 B2 2/2007 Lee et al.
7,236,695 B1 * 6/2007 Demos ..... 396/3
7,380,765 B2 * 6/2008 Shiff ..... 248/448
7,543,790 B2 * 6/2009 Starcher ..... 248/460
7,789,430 B2 * 9/2010 Wittmeyer et al. ..... 281/29
2007/0040089 A1 * 2/2007 Shiff ..... 248/448

* cited by examiner

*Primary Examiner* — Amy J Sterling
(74) *Attorney, Agent, or Firm* — Patrick Reilly; Colin Fowler

(57) ABSTRACT

A folding presentation pad easel, particularly suited for a classroom or teaching environment, utilizes a support spine and a leg element with additional legs to form a rigid triangular base, a supporting column, and a telescopic support, with pivotal supports therebetween. Superior stability is provided as well as a minimum required floor space to the rear of the easel, a feature which is particularly desirable in a classroom. When the easel is folded it has a set of wheels and a handle in which can be used for mobility.

20 Claims, 18 Drawing Sheets

PRESENTATION PAD EASEL

BACKGROUND OF THE INVENTION

1. Field of the Invention

The present invention relates generally to the holding of and presentation of presentation pads. The present invention more particularly relates to an effective way to display, pack, and transport a presentation pad.

2. Description of the Background Art

The prior art and related art includes efforts to provide flip chart easels that enable the use of commercially available prior art presentation pads, e.g., flip charts. These prior art flip charts do not support the convenient use of both sides of the pages of the prior art flip chart. Flip chart pages are thus often discarded with a side unused. This wastage of flip chart paper is contrary to an increasing public desire to reduce the environmental burden of paper products.

There is therefore a long felt need to provide an easel for a presentation pad that supports the convenient use of both sides of display sheets supported by the easel.

The principal objective of the present invention is to provide a device that can support the convenient use of both sides of a presentation pad supported by the easel. This and other objectives of the invention will be apparent to those skilled in this field from the following description of preferred embodiments of the invention

SUMMARY OF THE INVENTION

Towards this object and other objects that will be made obvious in light of this disclosure, a first preferred configuration of the present invention includes an easel comprising a support spine, a leg element, two legs, two to four support arms, a dragging handle, a two or more wheels, a height extension feature, and may be either expanded or folded into a compact travel configuration.

INCORPORATION BY REFERENCE

U.S. Pat. No. 5,010,671 (Inventor: Stonehouse, D. R.; issued on Apr. 30, 1991) tiled "Flip chart pad"; U.S. Pat. No. 5,697,595 (Inventor: Sperber, G.; issued on Dec. 16, 1997) titled "Flip chart"; U.S. Pat. No. 6,647,652 (Inventors: Seiber, et al.; issued on Nov. 18, 2003) titled "Display board system"; U.S. Pat. No. 6,889,952 (Inventors: Cook, et al.; issued on May 10, 2005) titled "Multi-position presentation easel"; and U.S. Pat. No. 7,178,778 (Inventor: Lee, W. S.; issued on Feb. 20, 2007) titled "Portable easel" are incorporated herein by reference and for all purposes. In addition, each and all publications, patents, and patent applications mentioned in this specification are herein incorporated by reference to the same extent, in their entirety and for all purposes, as if each individual publication, patent, or patent application was specifically and individually indicated to be incorporated by reference.

BRIEF DESCRIPTION OF THE DRAWINGS

These, and further features of the invention, may be better understood with reference to the accompanying specification and drawings depicting the preferred embodiment, in which.

DETAILED DESCRIPTION OF A PREFERRED EMBODIMENT

In describing the preferred embodiments, certain terminology will be utilized for the sake of clarity. Such terminology is intended to encompass the recited embodiment, as well as all technical equivalents, which operate in a similar manner for a similar purpose to achieve a similar result.

Figure 1:
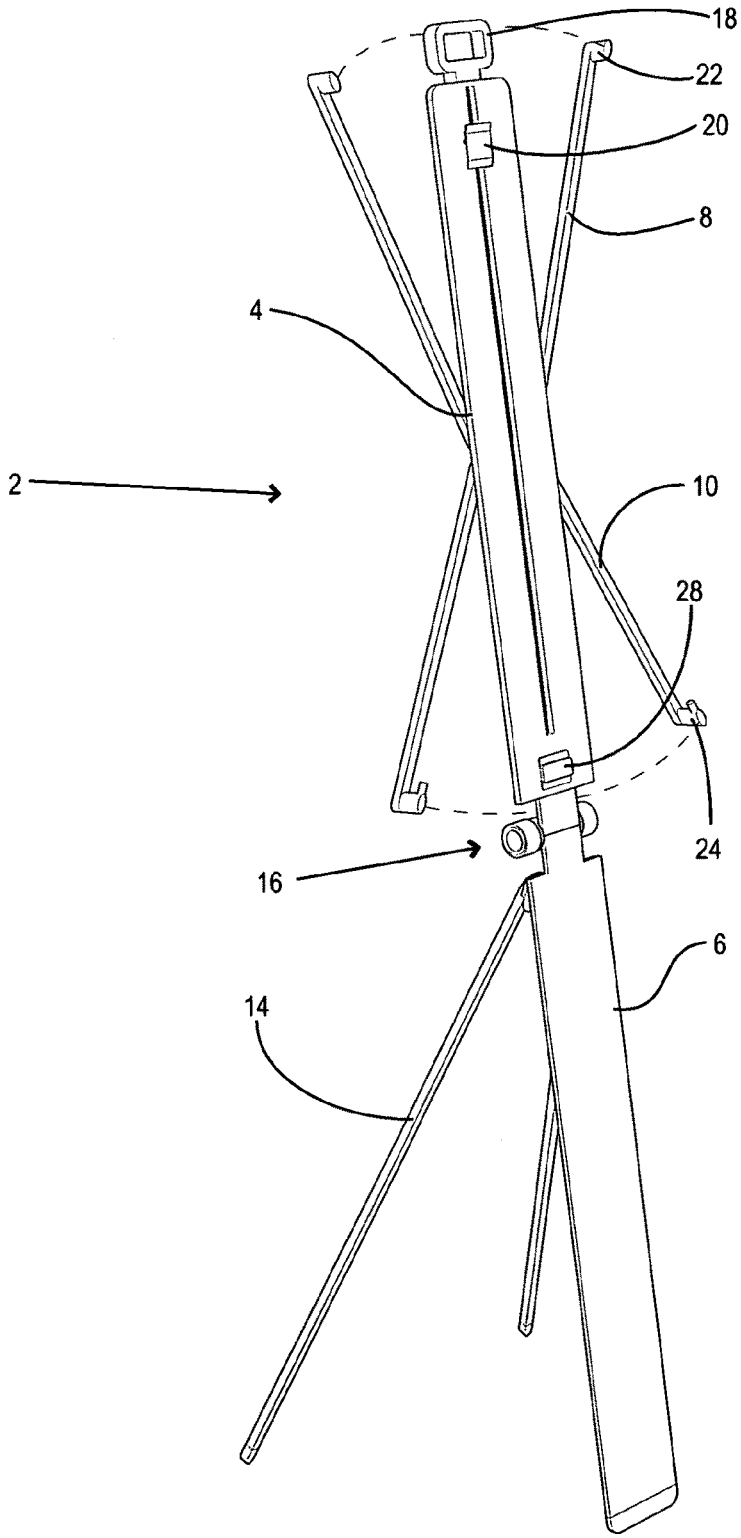
FIG. 1 is a front view of an invented easel in a set up configuration.
Figure 2:
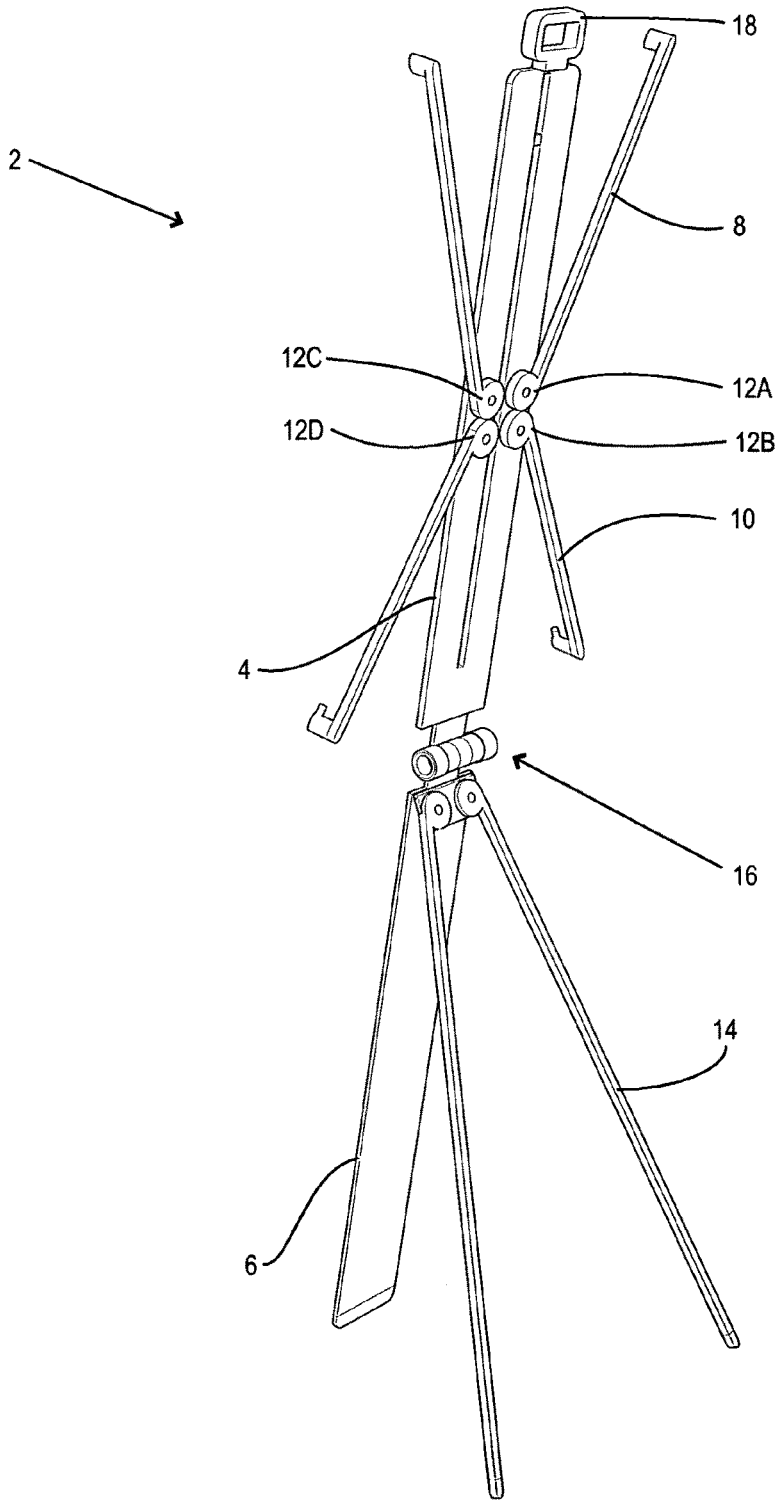
FIG. 2 is a rear view of the easel of FIG. 2 in a set up configuration.

Referring now generally to the Figures and particularly to FIGS. 1 and 2, FIG. 1 is a front view of the easel 2 in a set up configuration, FIG. 2 is a rear view of the same. The invented easel 2 includes a supporting spine 4 and a leg element 6 foldable toward each other in the manner of a clamshell, as well as a set of rotatable upper arms 8 and a set of lower arms 10 extending from specific anchor points 12A-D of the of the support spine 4, and a set of support legs 14 that may extend backwards from the top of the leg element 6. Optionally a wheel assembly 16 can be coupled between the support spine 4 and the leg element 6 with a handle 18 mounted at the top of the support spine 4 for carrying or dragging when the invented easel 2 is folded up. Just below the handle 18, mounted on the front of the support spine 4 is an optional support clip 20 which can be used to support a display pad (not shown). The upper arms 8 are configured to have at their ends, a securing feature 22 which can be used to steady a display pad. The lower arms 10 are configured to have at their ends, a holding feature 24 for bearing at least part of the weight of a display pad.

Figure 3:
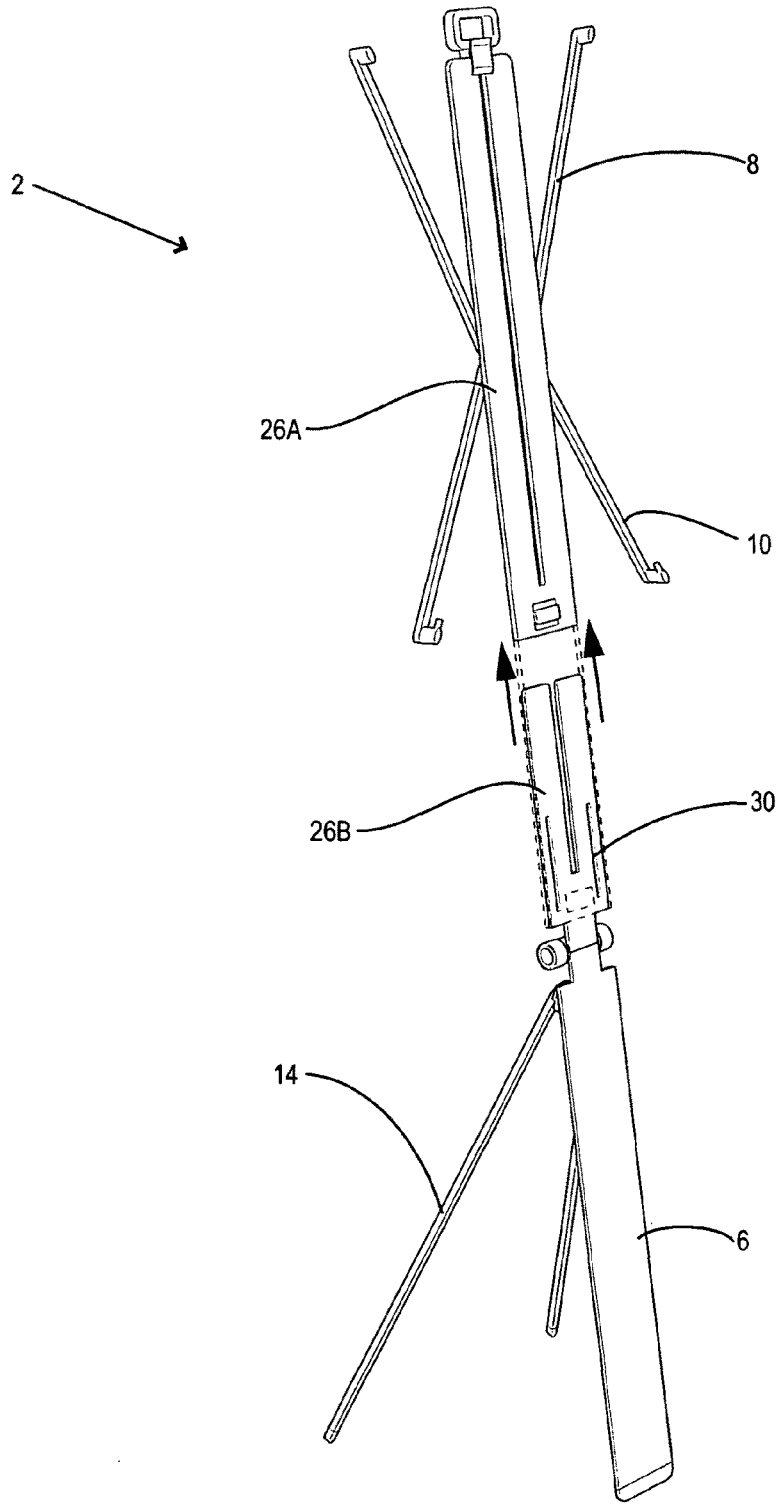
FIG. 3 is a front view of the easel of FIG. 2 in a set up configuration, depicting an adjustable height feature.
Figure 4:
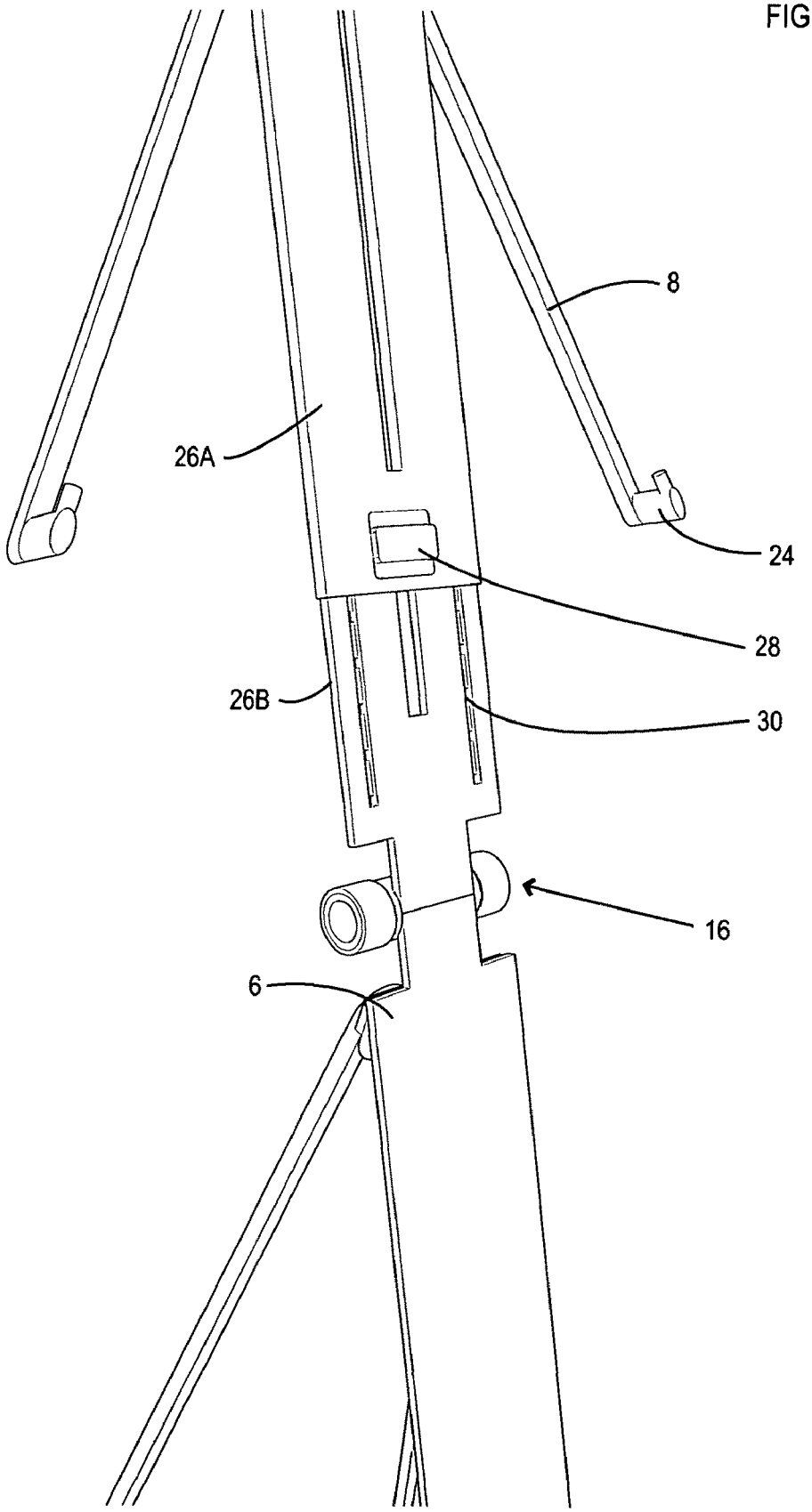
FIG. 4 is a close up view of an optional aspect of the easel of FIG. 2 having an adjustable height feature.

Referring now generally to the Figures and particularly to FIGS. 3 and 4, FIG. 3 is a front view of the invented easel 2 in a set up configuration, depicting an optional adjustable height feature 26 and FIG. 4 is a close up view of the optional adjustable height feature 26. At a support spine base 26A of the support spine 4, a locking control button 28 is affixed in order to facilitate adjustments of the easel's 2 extension from the leg element 6 and additionally can bear weight of the display pad.

According to the adjustable height feature 26, the support spine 4 is comprised of the support spine base 26A and a support spine extension 26B. The support spine base 24A is attached by a locking track mechanism 30 to the support spine extension 26B. The locking control button 28 is configured to adjustably engage and disengage with the locking track mechanism 30 by user manipulation of the locking control button 28. The position of the support spine base 26A along the locking track 30 is adjustable in height. The extension of the support spine base 26A in relation to the wheel assembly 16 is adjustable along the locking track mechanism 30 user manipulation of the locking control button 28.

Figure 5:
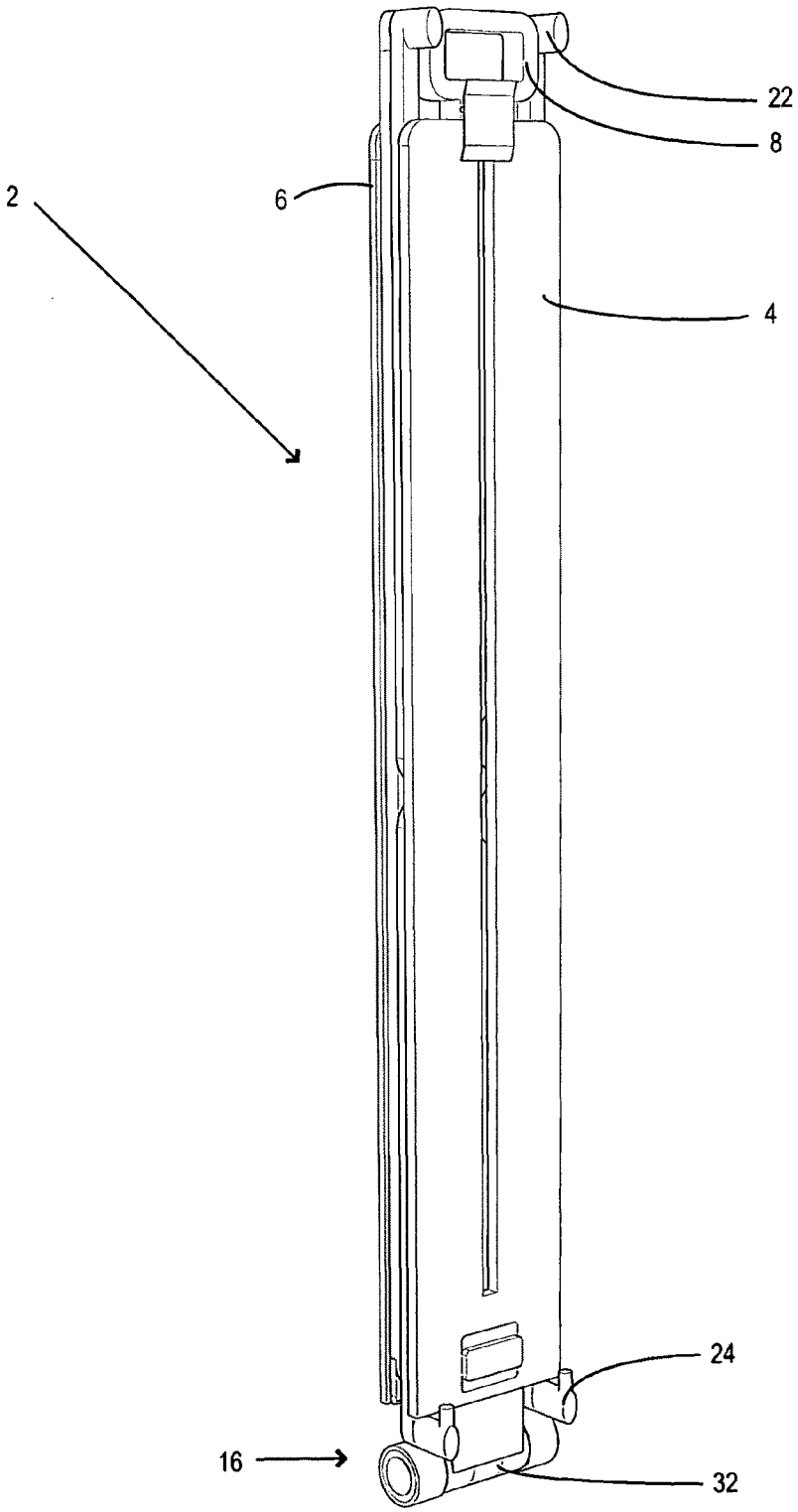
FIG. 5 is a front view of the easel of FIG. 2 in a travel configuration.
Figure 6:
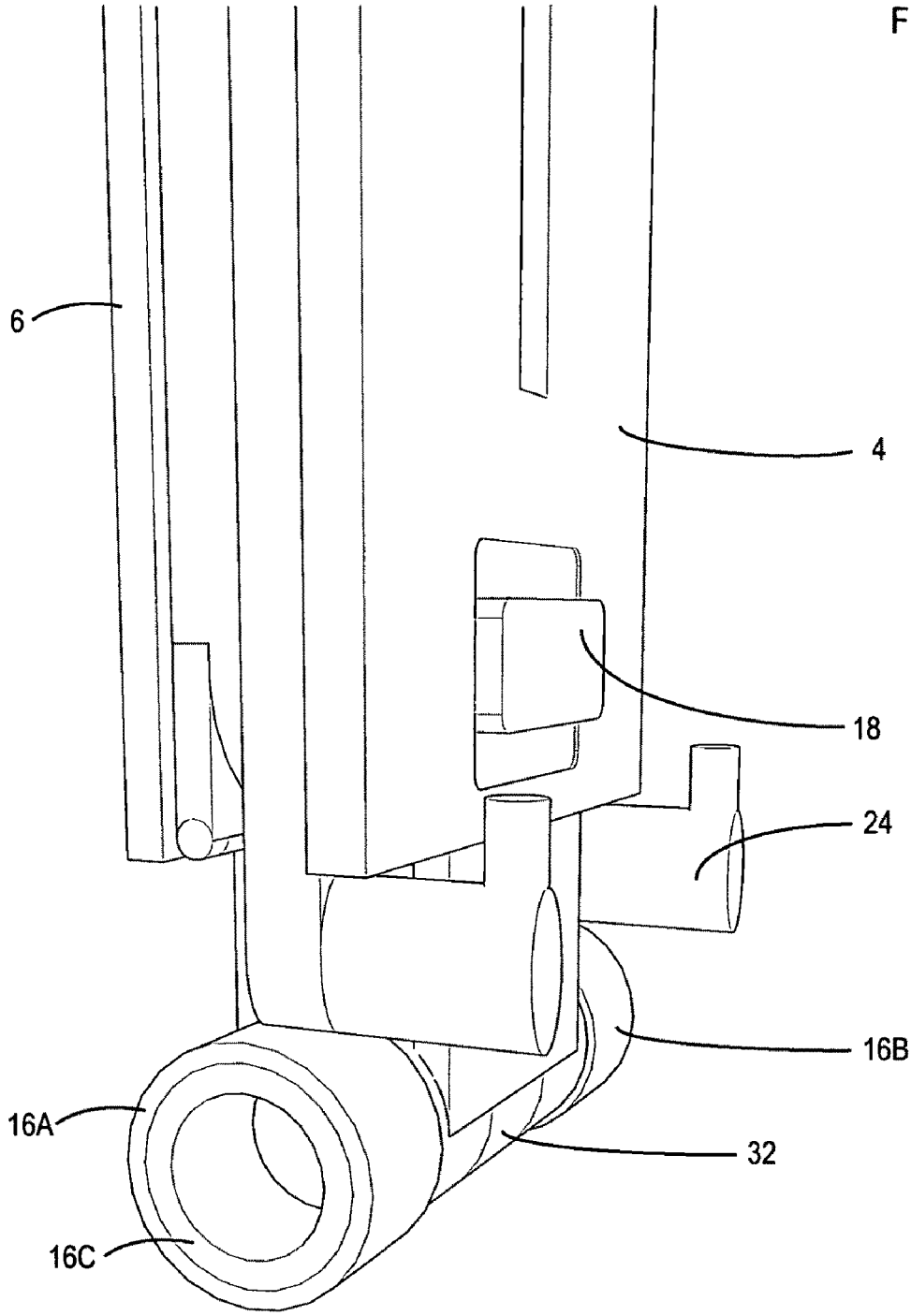
FIG. 6 is a close up view of the easel of FIG. 2 in a travel configuration.
Figure 7:
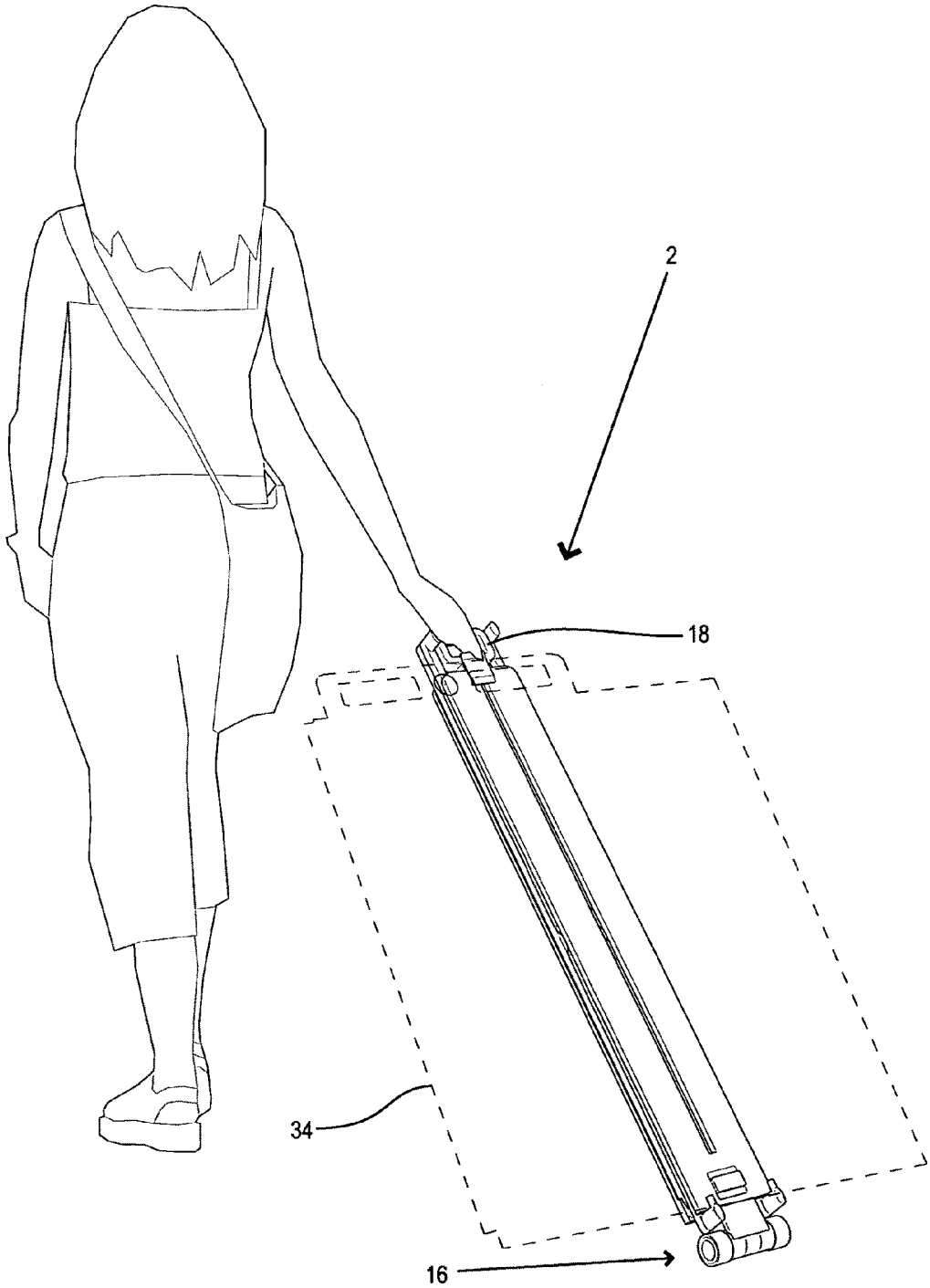
FIG. 7 is a view of the easel of FIG. 2 being used in a travel configuration.

Referring now generally to the Figures and particularly to FIGS. 5, 6 and 7, FIG. 5 is a front view of the invented easel 2 in a travel configuration, FIG. 6 is a close up view of the easel 2 in a travel configuration, FIG. 7 is a view of the easel 2 being used in a travel configuration. The invented easel 2 can be folded up in a more compact form in order to transport more easily. Between the leg element 6 and the support spine 4, a pivot point 32 which uses a suitable resistance or locking mechanism known in the art to sustain an affixed position is coupled to a wheel assembly 16 in order to make dragging the invented easel 2 more effortless. The wheel assembly includes a first wheel 12A, a second wheel 12B and a circular support 12C.

Figure 8:
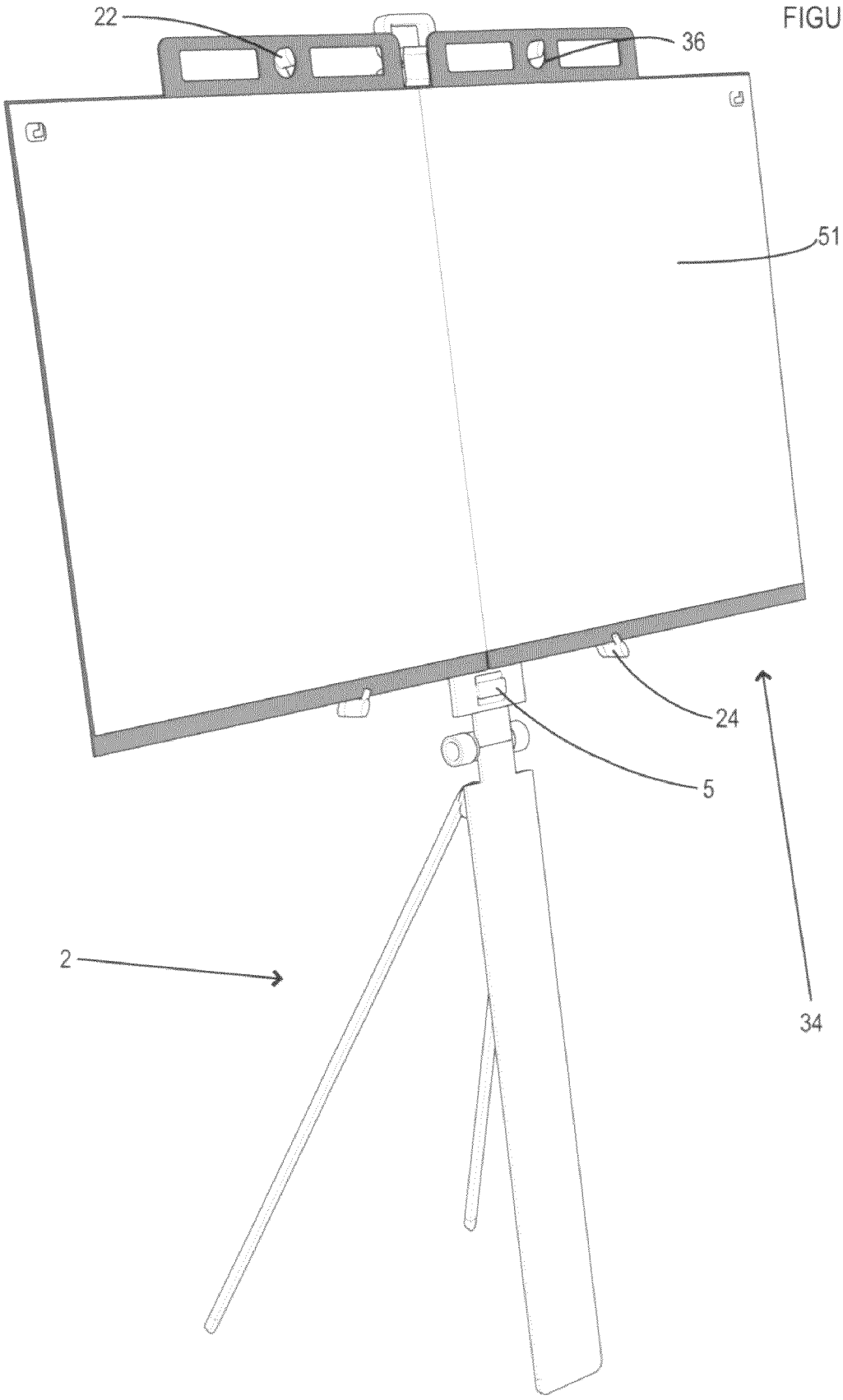
FIG. 8 is a front view of the easel of FIG. 2 being used in conjunction with an invented turn chart.
Figure 9:
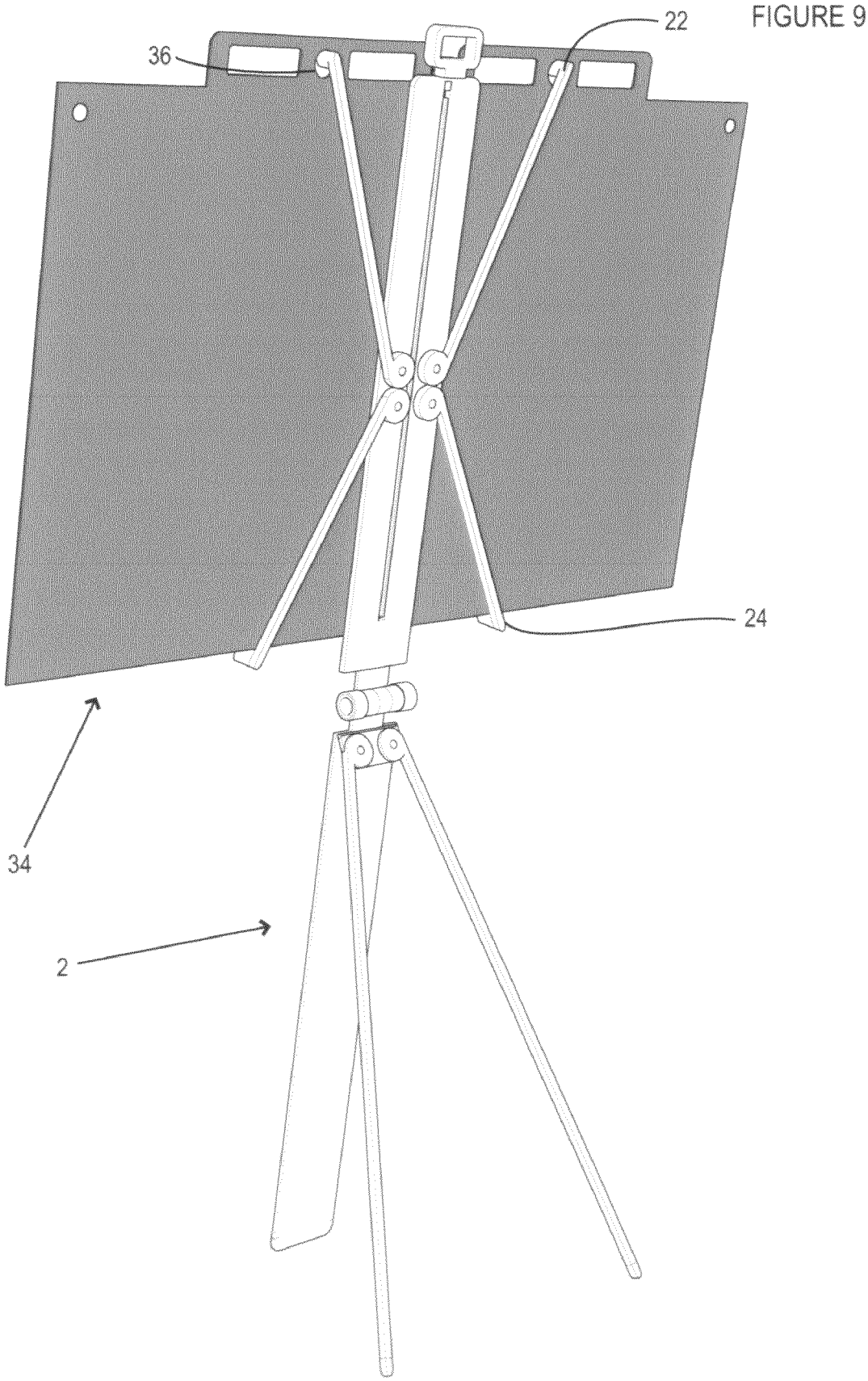
FIG. 9 is a rear view of the easel of FIG. 2 being used in conjunction with an invented turn chart.

Referring now generally to the Figures and particularly to FIGS. 8 and 9, FIG. 8 is a front view of the easel 2 being used in conjunction with an invented presentation pad 34 (hereinafter "turn chart" 34), while FIG. 9 is a rear view of the easel 2 being used in conjunction with an invented turn chart 34. In these figures the securing feature 22 of the upper arms 8 of the invented easel 2 is shown protruding through an aperture 36 of the turn chart 34. The securing features 22 stabilize the turn chart 34 by preventing motion. The holding features 24 of the lower arms 10 of the invented easel 2 are shown steadying a turn chart 34.

It is understood that the easel 2 may be configured to support a prior art presentation pad, such as a LEGACY ROTAFOLIO PAD(™) presentation pad, part number LOP21300, presentation pad, as marketed by Legacy Office Products of Indianapolis, Ind., or a LETR-TRIM PERFORATION(™) presentation pad, part number 7900, as marketed by TOPS Business Forms of St. Charles, Ill. It is further understood that the turn chart 34 may be configured shaped and sized to be supported by a prior art flip chart easel, such as a prior art easel suitable to support a prior art presentation pad, such as a LEGACY ROTAFOLIO PAD(™) presentation pad, part number LOP21300, presentation pad, as marketed by Legacy Office Products, or a LETR-TRIM PERFORATION(™) presentation pad, part number 7900, as marketed by TOPS Business Forms of St. Charles, Ill.

Figure 10:
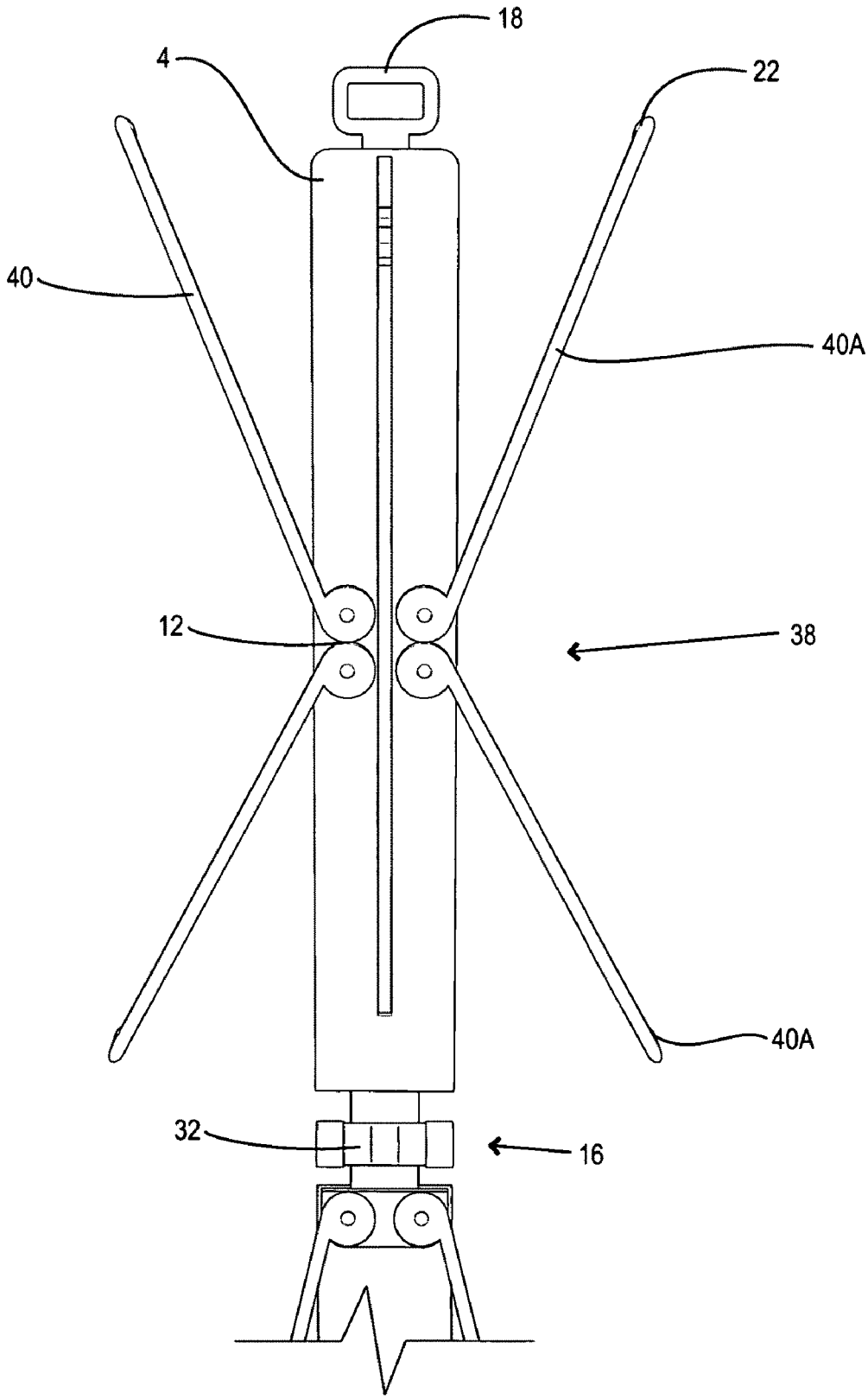
FIG. 10 is a rear view of an alternate configuration of the easel of FIG. 2.

Referring now generally to the Figures and particularly to FIG. 10, FIG. 10 is a rear view of an alternate configuration 38 of the easel 2. In this alternate configuration 38, rather than having a set of upper and lower arms 8, 10 instead two pivot arms 40 mounting at the same anchor point 12 act to support turn chart 34. An individual pivot arm 40 includes both a securing feature 22 at its peak and a holding feature 24 and its base. In as much as one pivot arm 40 must be behind the other in order to physically occupy the same anchor point 12, the securing feature 22 and holding feature 24 of the posterior pivot arm 40A, are enlarged to match up with the features 22, 24 of the adjoining pivot arm 40.

Figure 11:
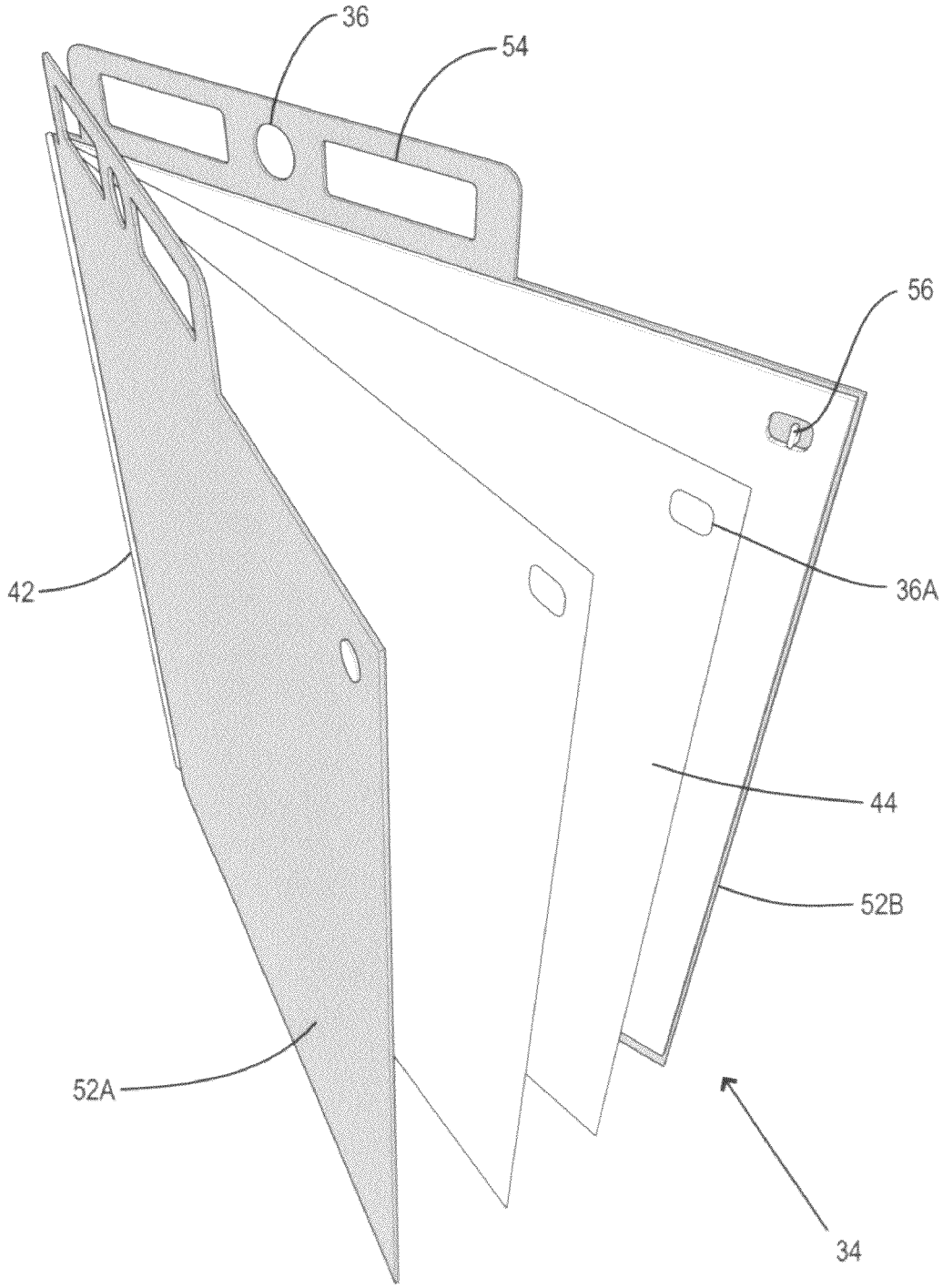
FIG. 11 is a side view of an invented turn chart of FIG. 2, showing multiple sheets.
Figure 12:
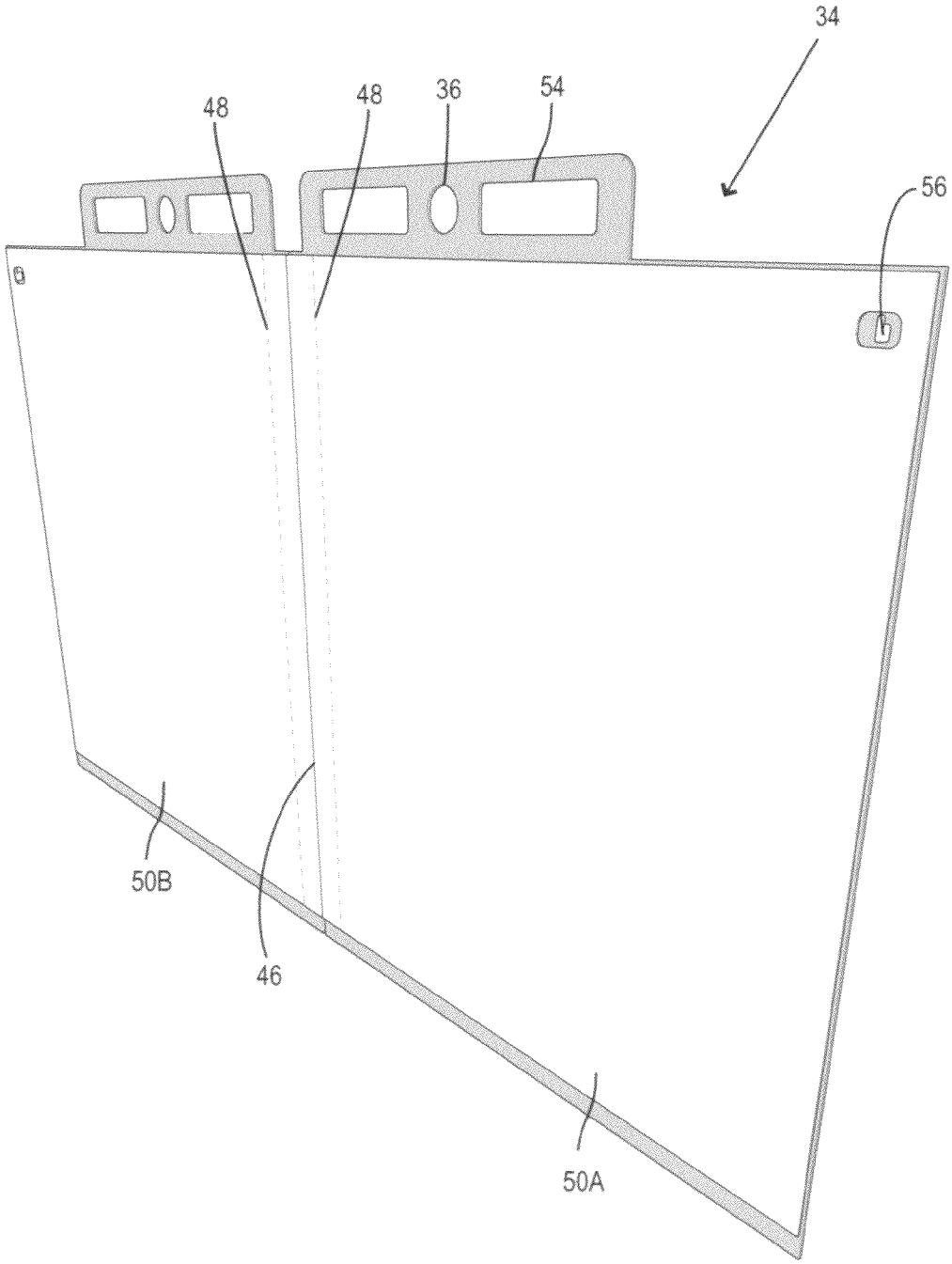
FIG. 12 is a front view of the turn chart of FIG. 11, showing an open configuration.
Figure 13:
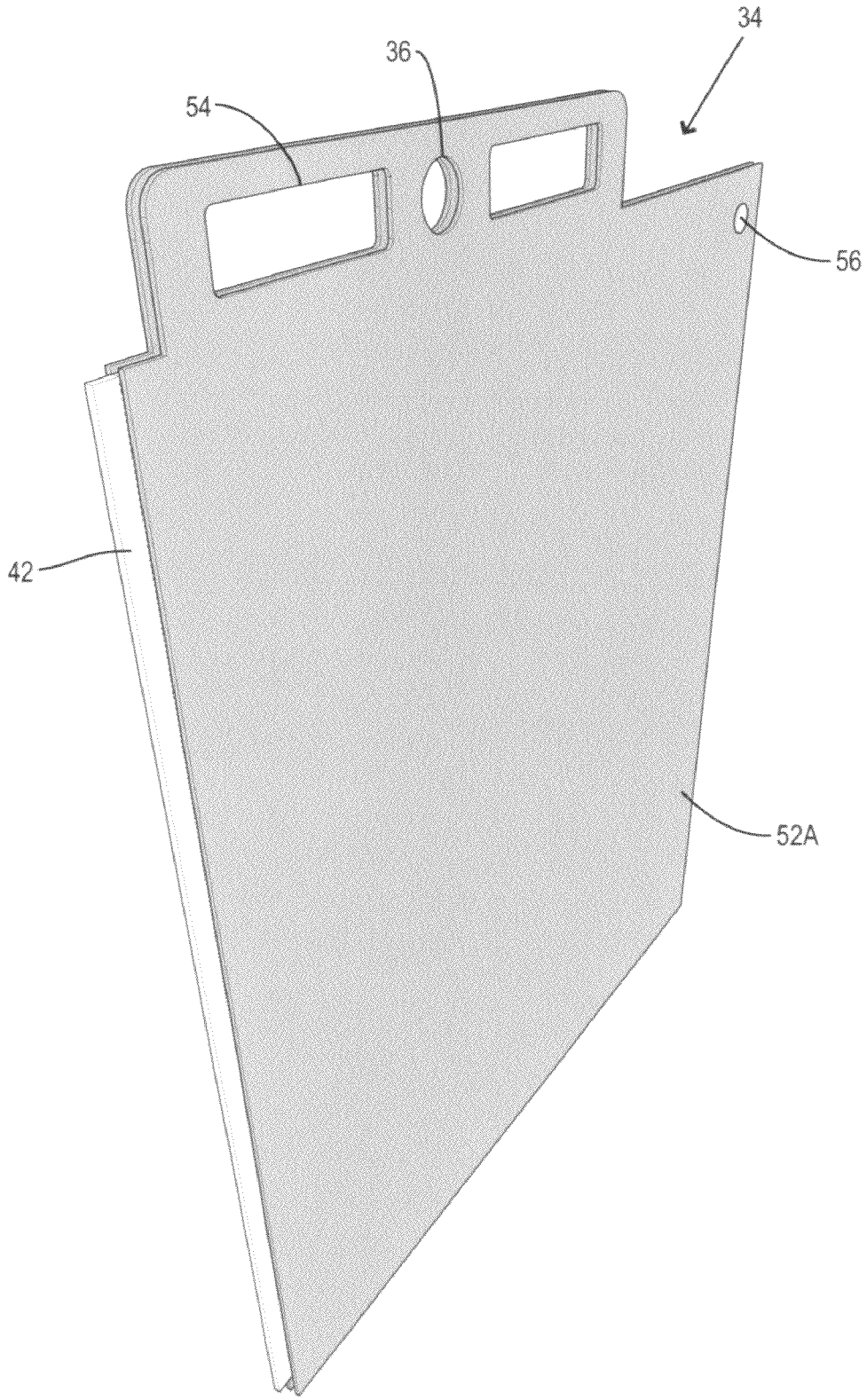
FIG. 13 is a rear view of the turn chart of FIG. 11, showing an attachment spine.

Referring now generally to the Figures and particularly to FIGS. 11, 12 and 13, FIG. 11 is a side view of the turn chart 34, showing multiple sheets 44, while FIG. 12 is a front view of the turn chart 34, showing an open configuration and FIG. 13 is a rear view of the turn chart 34, showing an attachment spine 42. The turn chart 34 includes a plurality of sheets 44 are bound by the attachment spine 42 and which may be flipped in a lateral direction. One or more sheets 44 may optionally be between one-thousandth and three one-thousandths thick and. The sheets 44 can optionally be made of cellulose pulp, recycled material, or other suitable material known in the art. Additionally these sheets 44 can take on any shape or color, though preferred configurations will include an essentially linear attachment edge 46. The sheets 44 may also include perforations 48 that are spread along an axis substantially parallel to, i.e. plus or minus 15 degrees from, the length of the attachment spine 42. The sheets 44 due to their flipping in a lateral direction may make use of both a front surface 50A and a back surface 50B for writing or display.

The turn chart 34 may be placed on the easel 2, or a suitable prior art easel known in the art, and have a first sheet 44 situated wholly to a user's left of the attachment spine 42, and with a second sheet to a user's right of the attachment spine 42. Users comfortable with reading from the left to the right, or from the right to the left, along a horizontal orientation may thus sense the turn chart 34 as having a layout of a published book or magazine. Turning the sheets 44 of the turn chart 34 to present a new or additional presentation surface 51 may be experienced by a user or observer as similar to the look and feel of turning the pages of a hard copy bound book.

In addition, a user can visually present more data or information on the presentation surface 51 than on a single sheet 44, and each sheet 44 may be separately removed form the turn chart 34 for attachment to a wall or other structure. Information may thus be grouped into topics and visual representations of information associated with a given topic may presented on a single sheet 44 and the single sheet may be separated from the turn chart 34 along a line of perforations 48. The separated sheet 44 may then be relocated from the turn chart 34 and visual presentation elsewhere. Simultaneously, other information may be continued to be visually presented from a second sheet 4 of a same writing surface 51 but is left on display by the easel 2.

The turn chart 34 may additionally include a front cover 52A and back cover 52B. Each cover 52A & 52B may include support apertures 36 for use in conjunction with the securing features 22, of the invented easel 2 and a handle 54 for use in transport.

Figure 14:
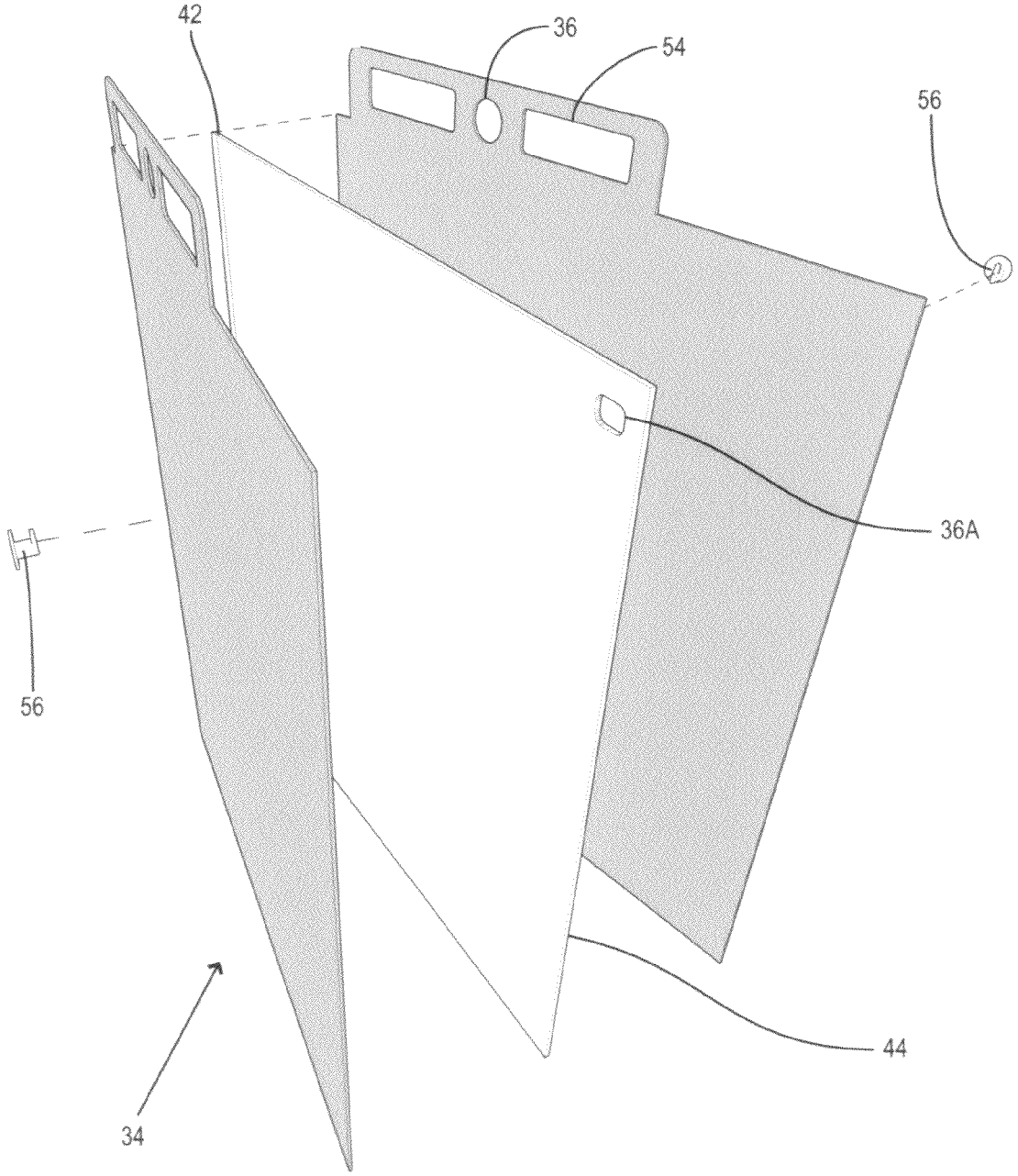
FIG. 14 is an exploded view of the turn chart of FIG. 11, showing construction therein.
Figure 15:
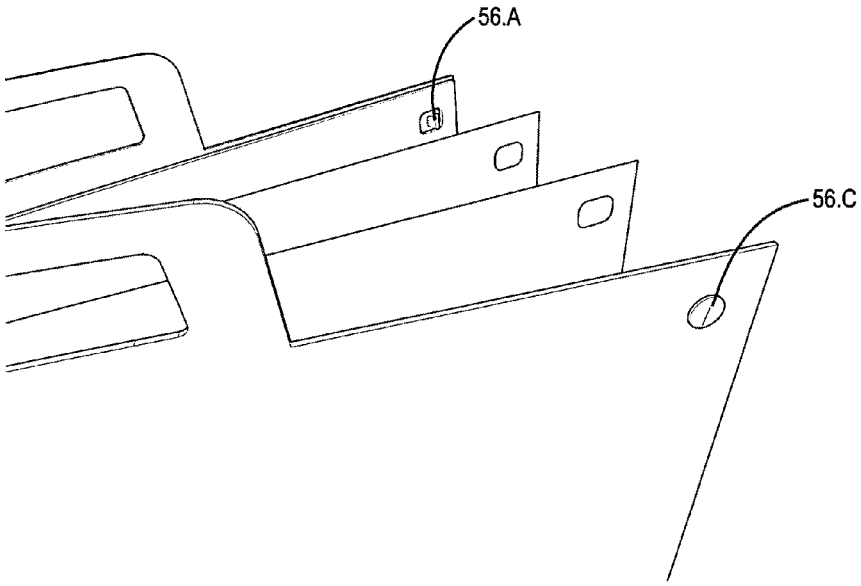
FIG. 15 is a view of several options for a cover support feature of the turn chart of FIG. 11.
Figure 15:
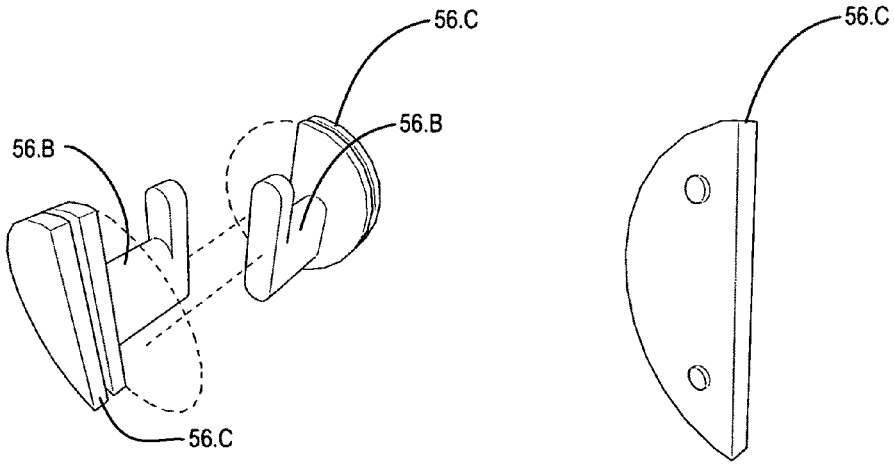

Referring now generally to the Figures and particularly to FIGS. 14 and 15, FIG. 14 is an exploded view of the turn chart 34 showing construction therein, while FIG. 15 is a view of several options for a cover support feature 56. The cover 52 of the turn chart 34, in its top outer corner, may include cover support features 56, to be used in conjunction with support apertures 36A in adjoining corners of the sheets 44. These cover support features 56 are used to support the weight of the sheets 44 and to keep said sheets 44 a flat writing surface for a user. Optionally the cover support features 56A may match the shape and diameter of the support apertures 36A, having length enough that the combined they match the thickness of the plurality of sheets 44. Alternatively the cover support features 56B may match half the shape and diameter of the support apertures 36A and each have a length in which the entire plurality of sheets 44 may be supported, and when closed the two separate halves 56.B1 and 56.B2 meet flush.

An additional option for the cover support feature 56C comprises a hooked shape in which a plurality of sheets 44 may hang from.

Figure 16:
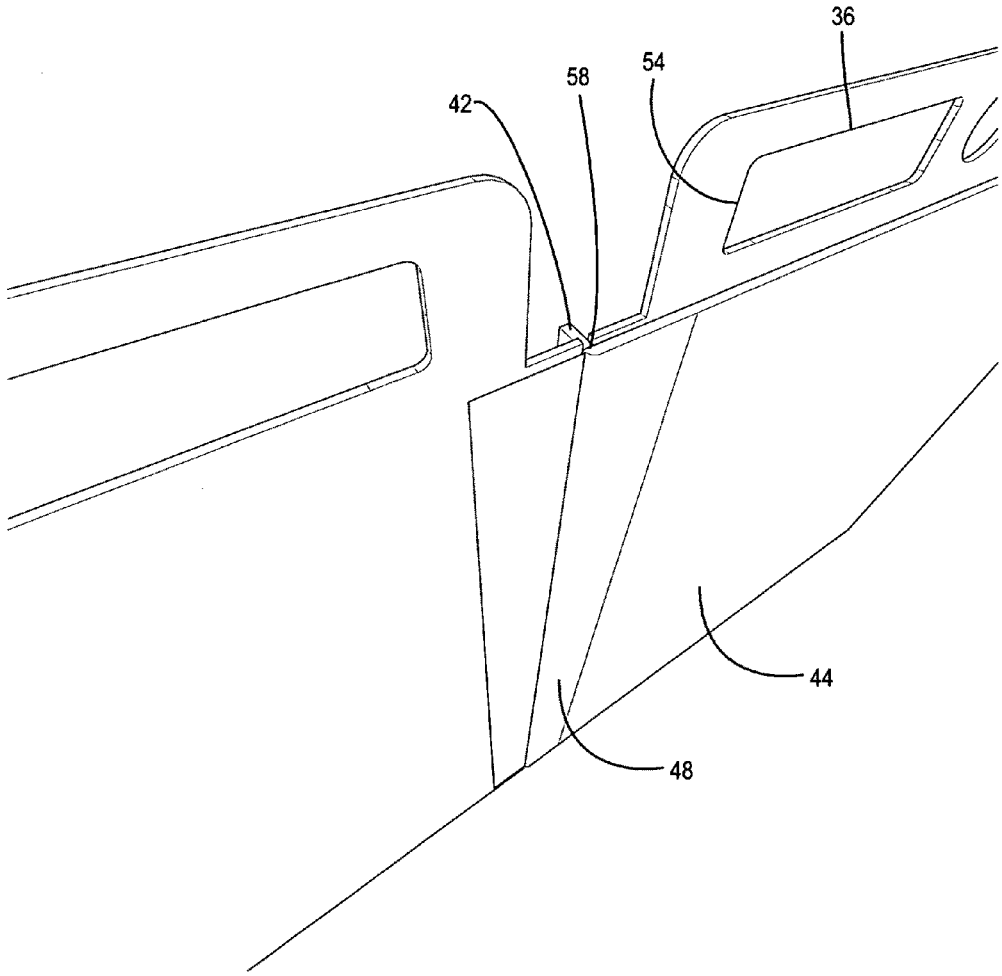
FIG. 16 is a close up, front view of an alternate configuration of the turn chart of FIG. 11 having an optional attachment spine.
Figure 17:
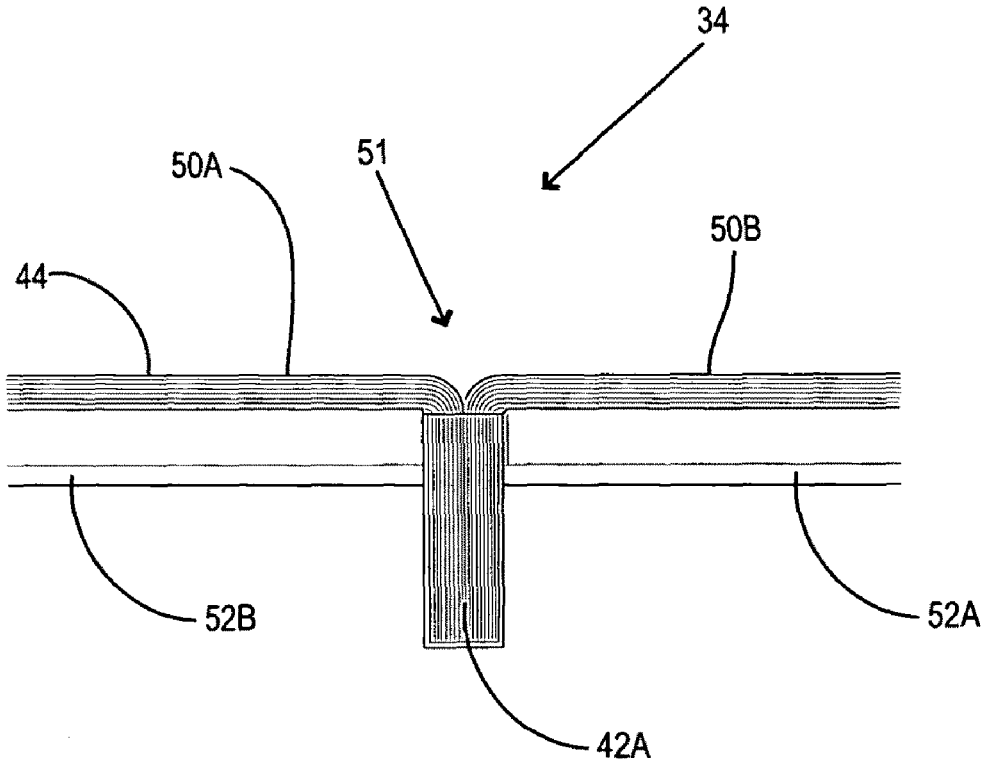
FIG. 17 is a top view of an alternate configuration of an alternate configuration of the turn chart of FIG. 11 having an arced attachment spine.

Referring now generally to the Figures and particularly to FIGS. 14, 16, 17 and 18; FIG. 14 is an exploded view of the turn chart 34 showing construction therein, while FIG. 16 is a close up, front view of the turn chart 34 showing an attachment spine and FIG. 17 is a top view of an alternate configuration of an turn chart 34 having a shaped attachment spine 42A. The shaped attachment spine 42A supports sheets 44 of the turn chart 34, such as the plurality of sheets 44 and the optional covers 52A and 52B and may be formed in a variety of ways known in the art either by a tight bond between a plurality of sheets 44 through either an adhesive 58 or bindings, or alternatively a shaped attachment spine 42A may be used in order to give the shaped spine 42A an arced shape to support a leveling of the writing surface 51 of the sheets 44 formed by a front surface 50A of one sheet 44 and a back surface 50B of a neighboring sheet 44. This shaped attachment spine 42A can be made from plastic metal, or any suitable material known in the art and may be bound to either a plurality of sheets 44 or to the supporting spine 4 in various configurations of the easel 2 and the turn chart 34.

Figure 18:
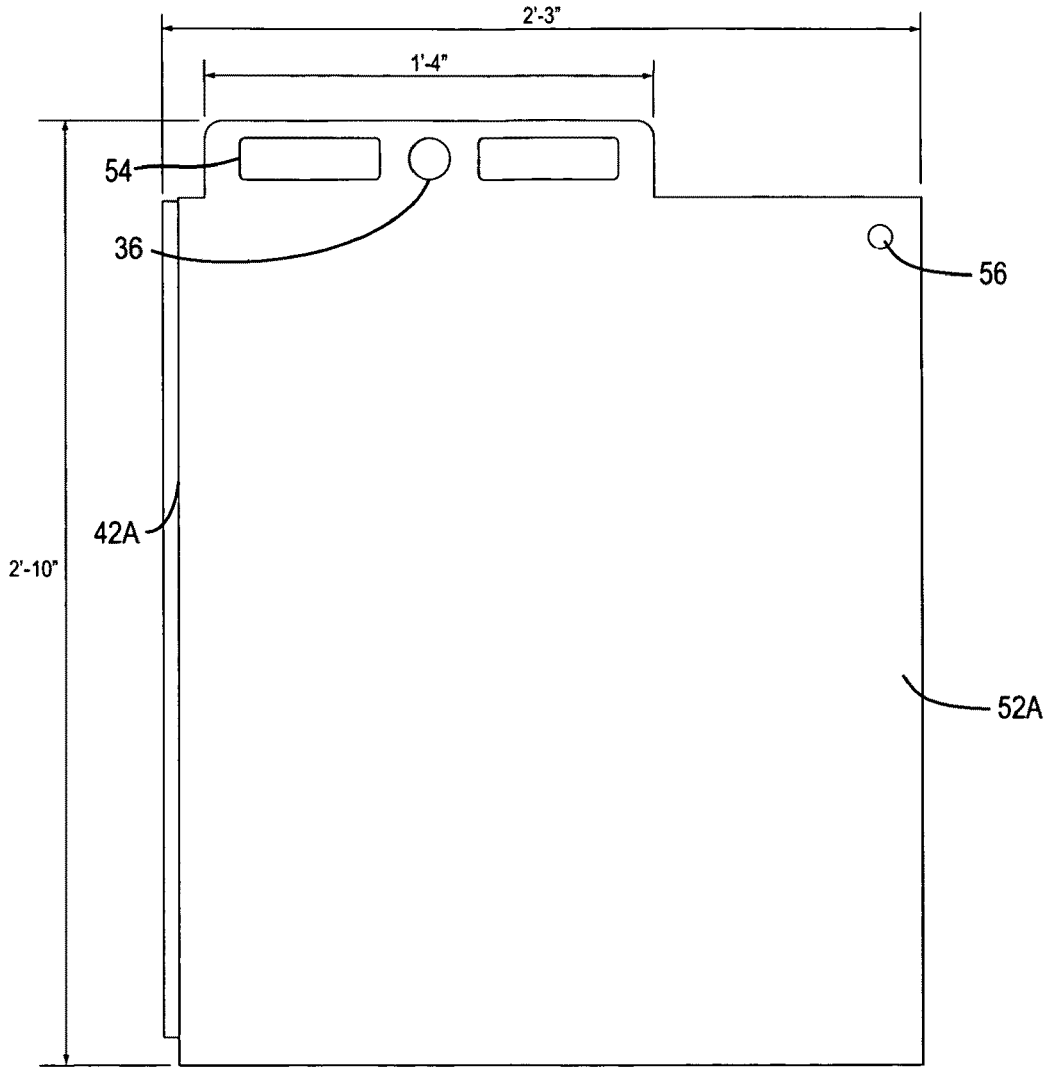
FIG. 18 is a side view of an alternate configuration of the turn chart of FIG. 11, having preferred dimensions.

FIG. 18 is a side view of the turn chart 34, showing preferred dimensions of certain alternate aspects 36, 42, 52A, 56, and 54 of the turn chart 34.

The foregoing disclosures and statements are illustrative only of the Present Invention, and are not intended to limit or define the scope of the Present Invention. The above description is intended to be illustrative, and not restrictive. Although the examples given include many specificities, they are intended as illustrative of only certain possible configurations or aspects of the Present Invention. The examples given should only be interpreted as illustrations of some of the preferred configurations or aspects of the Present Invention, and the full scope of the Present Invention should be determined by the appended claims and their legal equivalents. Those skilled in the art will appreciate that various adaptations and modifications of the just-described preferred embodiments can be configured without departing from the scope and spirit of the Present Invention. Therefore, it is to be understood that the Present Invention may be practiced other than as specifically described herein. The scope of the present invention as disclosed and claimed should, therefore, be determined with reference to the knowledge of one skilled in the art and in light of the disclosures presented above.

What is claimed is:

1. An easel comprising:

(a.) a supporting spine, the supporting spine providing a continuous support surface along an height dimension of a display pad;

(b.) a first lower arm and a second lower arm extending down from anchor points on the supporting spine, the first lower arm and the second lower arm each having a holding feature for bearing at least part of the weight of the display pad; and (c.) a first upper and a second upper arm extending up from anchor points on the supporting spine, the first upper arm and the second upper arm each having a securing feature adapted to extend through the display pad for positioning the display pad, wherein the first lower arm, the second lower arm, the first upper arm and the second upper arm couple the display pad with the supporting spine.

2. The easel of claim 1, wherein the securing features extend through the display pad.

3. The easel of claim 1, wherein the lower arm holding features are located below the display pad when the display pad is mounted to the easel.

4. The easel of claim 1, further comprising a handle, the handle configured for manual carrying of the easel in a travel position.

5. The easel of claim 1, wherein the two lower arms are rotatably coupled to the supporting spine, wherein the two lower arms are rotatable to a travel position behind the supporting spine.

6. The easel of claim 5, wherein the two upper arms are rotatably coupled to the supporting spine, wherein the two upper arms are rotatable to a travel position behind the supporting spine.

7. The easel of claim 1, wherein the two upper arms are rotatably coupled to the supporting spine, wherein the two upper arms are rotatable to a travel position behind the supporting spine.

8. The easel of claim 1, wherein the first upper arm and the second lower arm form a first unified arm body, and the first unified arm body is rotatably coupled to the supporting spine, wherein the two upper arms are rotatable to a travel position behind the supporting spine.

9. The easel of claim 8, wherein the second first upper arm and the first lower arm form a second unified arm body, and the second unified arm body is rotatably coupled to the supporting spine, wherein the two upper arms are rotatable to a travel position behind the supporting spine.

10. The easel of claim 1, further comprising a leg element, wherein a leg element is rotatably coupled with the supporting spine, and wherein the leg element is rotatable to a travel position behind the supporting spine.

11. The easel of claim 10, further comprising a locking feature, the locking feature configured to detachably couple the supporting spine and the leg element as a rigid structure.

12. The easel of claim 10, further comprising a second leg and a third leg, the second leg and the third leg are coupled with the leg element and are configured to form a supporting tripod with the leg element.

13. The easel of claim 12, wherein the second leg and the third leg are rotatably coupled with the leg element and are rotatable to a travel position behind the supporting spine.

14. The easel of claim 13, further comprising a locking feature, the locking feature configured to detachably couple the supporting spine and the leg element as a rigid structure.

15. The easel of claim 14, further comprising a handle, the handle configured for manual carrying with the easel in a travel position.

16. The easel of claim 1, wherein the two securing features are equidistant from a longitudinal axis of the supporting spine when the two securing features are coupling the display pad to the supporting spine.

17. The easel of claim 1, wherein the two holding features are equidistant from a longitudinal axis of the supporting spine when the two securing features are at least partly bearing the weight of the display pad.

18. The easel of claim 17, wherein the two securing features are equidistant from a longitudinal axis of the supporting spine when the two securing features are coupling the display pad to the supporting spine.

19. The easel of claim 10, further comprising a slidable element, the slidable element disposed between the locking feature and the arms and enabling vertical positioning of the display pad.

20. The easel of claim 10, further comprising a wheel element, the wheel element configured to enable manual rolling of the easel in the travel position.

* * * * *